US005941301A

United States Patent [19]

Baumann

[11] Patent Number: 5,941,301

[45] Date of Patent: Aug. 24, 1999

[54] STEAM CONDENSER

[75] Inventor: Peter Baumann, Sulz, Switzerland

[73] Assignee: Asea Brown Boveri AG, Baden, Switzerland

[21] Appl. No.: 08/909,736

[22] Filed: Aug. 12, 1997

[30] Foreign Application Priority Data

Oct. 12, 1996 [DE] Germany ..... 196 42 100

[51] Int. Cl.[6] ..... F28G 9/10

[52] U.S. Cl. ..... 165/114; 165/113

[58] Field of Search ..... 165/114, 113, 165/111, 112

[56] References Cited

U.S. PATENT DOCUMENTS

| | | | |
|---|---|---|---|
| 1,578,031 | 3/1926 | Hodgkinson | 165/114 |
| 1,812,591 | 6/1931 | Grace | 165/114 |
| 2,848,197 | 8/1958 | Evans, Jr. et al. | 165/114 X |
| 2,869,833 | 1/1959 | Aronson et al. | 165/114 |
| 2,939,685 | 6/1960 | Worn et al. | 165/114 |
| 4,967,833 | 11/1990 | Blangetti et al. | 165/114 |
| 5,018,572 | 5/1991 | Blangetti et al. | 165/114 X |
| 5,465,784 | 11/1995 | Blangetti et al. | 165/114 |

FOREIGN PATENT DOCUMENTS

| | | |
|---|---|---|
| 0384200A1 | 8/1990 | European Pat. Off. . |
| 0325758A1 | 8/1989 | WIPO . |

*Primary Examiner*—Leonard R. Leo
*Assistant Examiner*—Christopher Atkinson
*Attorney, Agent, or Firm*—Burns, Doane, Swecker & Mathis, L.L.P.

[57] ABSTRACT

In a steam condenser which is set up in an on-floor arrangement and in which the steam is condensed on tubes through which cooling water flows and which are combined in separate banks, the tubes of a bank arranged in rows enclosing a hollow space, a cooler for the non-condensable gases is arranged in the hollow space. The sectional banks are horizontally directed in their longitudinal extent and are arranged vertically one above the other. The cooler for the non-condensable gases has its suction action directed toward a zone below the longitudinal center line of the individual bank. The hollow space is connected to a compensating lane in the interior of the bank, the longitudinal center line of which compensating lane, on account of the asymmetrical condensate loading in the horizontally oriented sectional bank and the asymmetrical localization of the pressure minimum in the tube assembly, runs below the longitudinal center line of the sectional banks.

1 Claim, 2 Drawing Sheets

STEAM CONDENSER

BACKGROUND OF THE INVENTION

1. Field of the Invention

The invention relates to a steam condenser for on-floor arrangement with a steam turbine, in which the steam is condensed on tubes through which cooling water flows and which are combined in separate sectional banks, for which purpose the sectional banks are horizontally directed in their longitudinal extent and a plurality of such sectional banks are arranged one above the other in the vertical, the tubes of a bank arranged in rows enclosing a hollow space in which a cooler for the non-condensable gases is arranged, and the mixture of non-condensable gases and steam which collects in the hollow space of the sectional bank being drawn off by the cooler, and the hollow space being connected to a compensating lane in the interior of the bank, which compensating lane ensures that the steam, enriched with inert gas, from the core of the front and the rear half of the bank is fed to the air cooler.

2. Discussion of Background

EP-A 0 384 200 discloses such a steam condenser. The condenser tubes are arranged in a plurality of sectional banks in a condenser casing. The steam flows through an exhaust-steam connection into the condenser casing and is distributed in the space by flow passages. The latter narrow in the general direction of the flow in such a way that an optimum pressure gradient is produced. The free inflow of the steam to the outer tubes of the sectional banks is ensured. The steam then flows through the banks with a small resistance due to the small depth of the tube rows. In order to be able to fulfill the condition of the steam velocity to be kept constant in the inflow passages, the sectional banks in the condenser are arranged one above the other in such a way that suitable flow passages are obtained between them. Furthermore, the tubes in the rows following one after the other form a wall which is closed upon itself and is preferably of identical thickness throughout.

The steam-side pressure drop over the bank is approximately constant as a result of the intentional realization of the reduction in pressure in the lanes, through which flow occurs, at the level of the air cooler on both sides of the respective bank. This results in a homogeneous pressure gradient in the direction of the cooler. Thorough flushing of steam through the bank is achieved by this measure. After passing through the maximum, velocity, the steam in the lanes is decelerated down to zero with recovery of pressure at the level of the condensate receiver. This causes an increase in the saturation temperature of the steam and thus a regeneration of the condensate undercooling which has taken place and of the oxygen concentration in the condensate. In addition, owing to the fact that the retention takes place only at the lower bank end due to the flow guidance selected, accumulations of non-condensable gases in the bank lanes themselves are avoided.

This known condenser has the advantage that, due to the more open arrangement of the sectional banks, all peripheral tubes of a sectional bank are readily fed with steam without a noticeable pressure loss. On the other hand, the requirement for an at least approximately uniform "wall thickness" of the tubed sectional bank around the hollow space results in a relatively large overall height of the sectional bank in its longitudinal extent. The excellent suitability of this concept for steam condensers of power station plants in which the condenser and the turbine are located at approximately the same level of the foundation of the power house results from the horizontal orientation of the sectional banks. In such cases, the condenser may be arranged coaxially to the turbine shaft or laterally along the turbine. Further advantages may be seen in the simple and quick production of the foundation as well as in short commissioning times. In particular, it is possible to dispense with the previous expansion members and to attach the condenser directly to the exhaust-gas casing of the turbine and to support the condenser by means of simple sliding shoes.

SUMMARY OF THE INVENTION

Accordingly, one object of the invention is to provide a novel condenser of the type mentioned at the beginning, in which the compensating lane which is in the interior of the bank and communicates with the hollow space is arranged in such a way that the steam, enriched with inert gas, from the core of the front and the rear half of the bank finds a frictionless path to the air cooler.

According to the invention, this is achieved in that the longitudinal center line of the compensating lane, on account of the asymmetrical condensate loading in the horizontally oriented sectional bank and the asymmetrical localization of the pressure minimum in the tube assembly, runs below the longitudinal center line of the sectional banks.

The advantage of the invention may be seen in the fact that it is ensured that the residual steam and the remaining inert gases can in fact also flow in a frictionless manner to the air cooler in the compensating lane in the interior of the bank, and no accumulations of inert gas occur in the bank interior.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying schematic drawings of a power station condenser, wherein.

Figure 1:
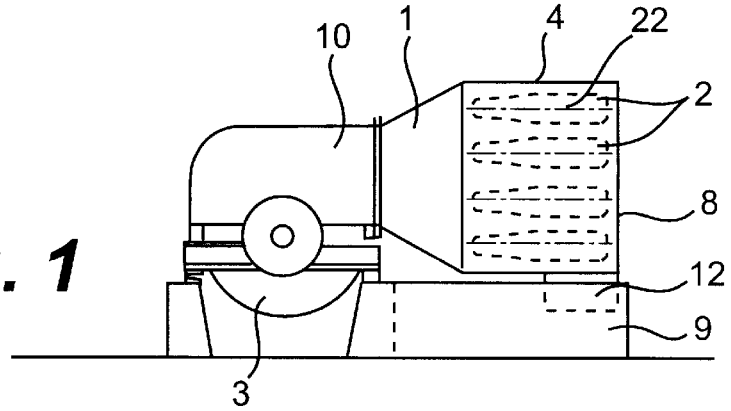
FIGS. 1 and 2 show a sketch of a low-pressure turbine together with condenser in front view and plan view.

The heat exchanger shown is a surface condenser of a rectangular type of construction, as suitable for the so-called on-floor arrangement.

DESCRIPTION OF THE PREFERRED EMBODIMENTS

Referring now to the drawings, wherein like reference numerals designate identical or corresponding parts throughout the several views, the steam flows into the condenser neck 1 via an exhaust-steam connection 10 with which the condenser is attached to the turbine. As homogeneous a flow zone as possible is produced therein in order to carry out thorough steam flushing of the downstream banks 2 over their entire length.

Figure 2:
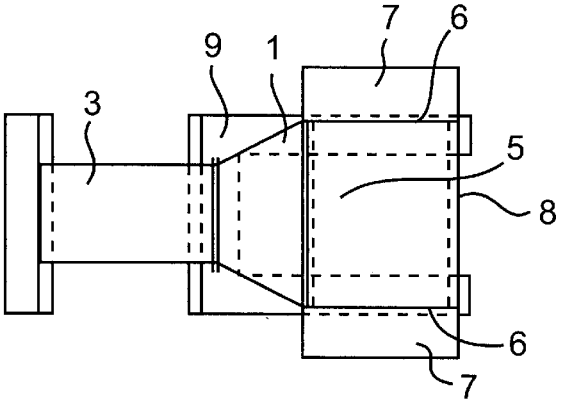

The condensation space in the interior of the condenser shell contains four separate banks 2. The aim of this, inter alia, is to enable a partial shutdown on the cooling-water side to be carried out even during operation of the plant, for example for the purpose of inspecting a shut down bank on the cooling-water side. The independent admission of cooling water is revealed by the fact that the water chambers 7 (FIG. 2) are subdivided into compartments by horizontal dividing walls (not shown).

The banks consist of a number of tubes 5 which are each fastened at their two ends in tube plates 6. The water chambers 7 are arranged in each case on the other side of the tube plates. The condensate flowing off from the banks 2 is collected in the condensate receiver 12 and passes from there into the water/steam cycle (not shown).

Figure 3:
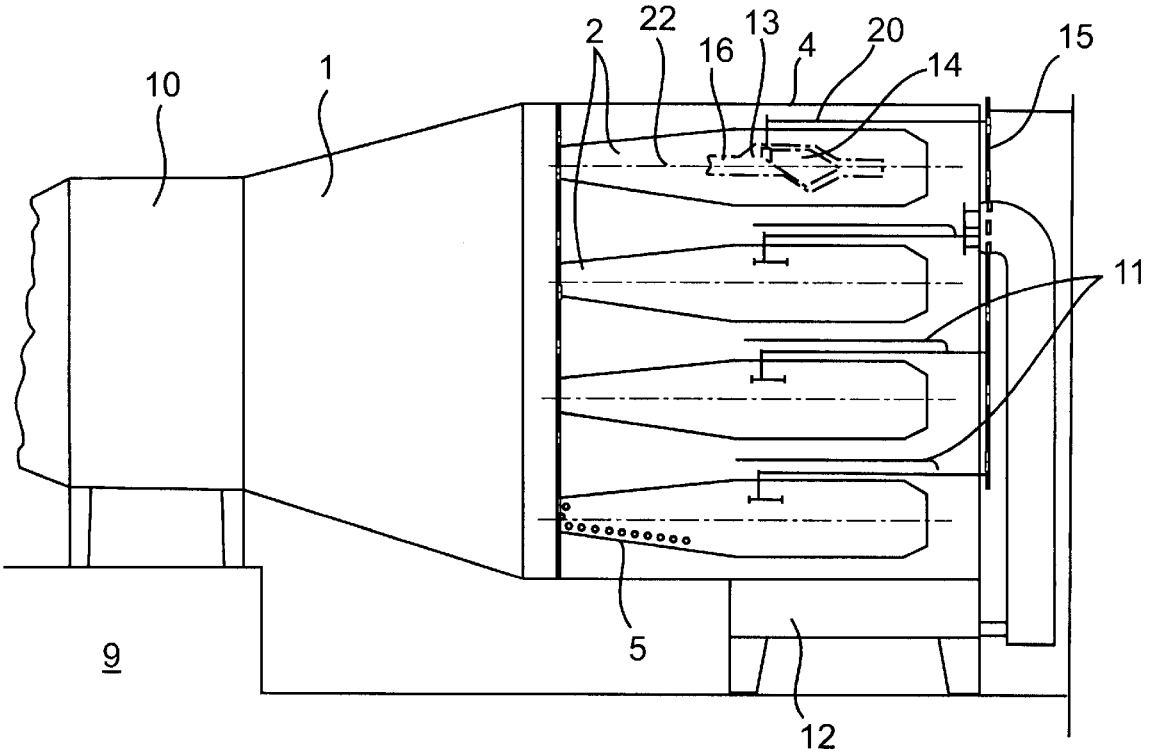
FIG. 3 shows a cross section through the condenser.

According to FIG. 3, a hollow space 13 is formed in the interior of each bank 2, in which hollow space the steam enriched with non-condensable gases—called inert gas below—collects. An air cooler 14 is accommodated in this hollow space 13. The steam/inert-gas mixture flows through this air cooler, in the course of which most of the steam condenses. The rest of the mixture is drawn off at the cold end. It should be noted here that the air cooler located in the interior of the tube bank has the effect of accelerating the steam/gas mixture inside the condenser bank. The conditions are thereby improved in as much as no low flow velocities which could impair the heat transfer prevail.

Starting from the predetermined external shape of the condenser—in the present case a parallelepiped-shaped condenser shell—the shape of the four banks 2 is adapted in such a way that the following aims are achieved:

good utilization of the temperature gradient low pressure drop in the tube bank despite high packing density of the tubing no stagnating accumulations of inert gas in the steam lanes and the banks no undercooling of the condensate good degassing of the condensate.

To this end, the banks are configured in such a way that steam is readily admitted to all tubes of the periphery without a noticeable pressure loss. In order now to ensure a homogeneous, thorough steam flow and in particular to rule out the possibility of accumulations within the bank, the existing flow paths between the four banks 2 on the one hand and between the outer banks and their adjacent condenser wall are designed as follows:

First of all it is assumed that a fairly homogeneous flow zone prevails over the entire outflow cross section of the condenser neck 1. The predominant first section of the flow path between the start and end of the bank is of convergent design. The flowing steam undergoes spatial acceleration therein with a corresponding reduction in the static pressure. This takes place more or less homogeneously on both sides of the banks. To be taken into account here is the fact that the steam mass flow, as a result of the condensation, becomes increasingly smaller at the passage constriction to be effected on both sides of the banks.

After the maximum predetermined velocity is reached, the steam is now decelerated to zero velocity with simultaneous recovery of pressure. This is achieved by the second section of the flow path being of divergent design. Here, too, it is necessary to take into account the fact that the passage widening, as a result of the ever decreasing mass flow, need not be optically perceivable. The decisive factor is that the residual steam flowing toward the condenser base 8 produces a dynamic pressure there. The steam is thereby deflected and thus also supplies the bottom sections of the banks. The temperature increase caused by the dynamic pressure benefits the condensate flowing off from tube to tube by virtue of the fact that the condensate heats up again if it has cooled down below saturation temperature. Two advantages are thereby obtained: there are no thermodynamic losses on account of condensate undercooling and the oxygen content of the condensate is reduced to a minimum.

As a further measure, which serves to admit steam uniformly to the banks, the air cooler 14 in the bank interior is arranged at that level at which the pressure profile in the lane through which flow occurs passes through a relative minimum on both sides of the banks. In the example shown, the air cooler is therefore located in the rear half of the sectional banks. The bank is configured in such a way that the intake of steam into the hollow space 13—with due regard to the effective pressure at the tube periphery and on account of the different tube-row depth—acts homogeneously in radial direction over all adjacent tubes in the hollow space 13. This results in a homogeneous pressure gradient and thus in a clear direction of flow of the steam and of the non-condensable gases toward the air cooler 14.

In operation, the steam condenses on the tubes 5 and the condensate drips off toward condensate-collecting plates 11. The condensate drips off inside the banks, in the course of which it comes into contact with steam of increasing pressure.

The entire construction unit of condenser shell, i.e. casing as well as sectional banks and condensate-collecting plates, is slightly inclined about the turbine axis in the longitudinal direction of the tubes in order to help the condensate to flow off rapidly.

Figure 4:
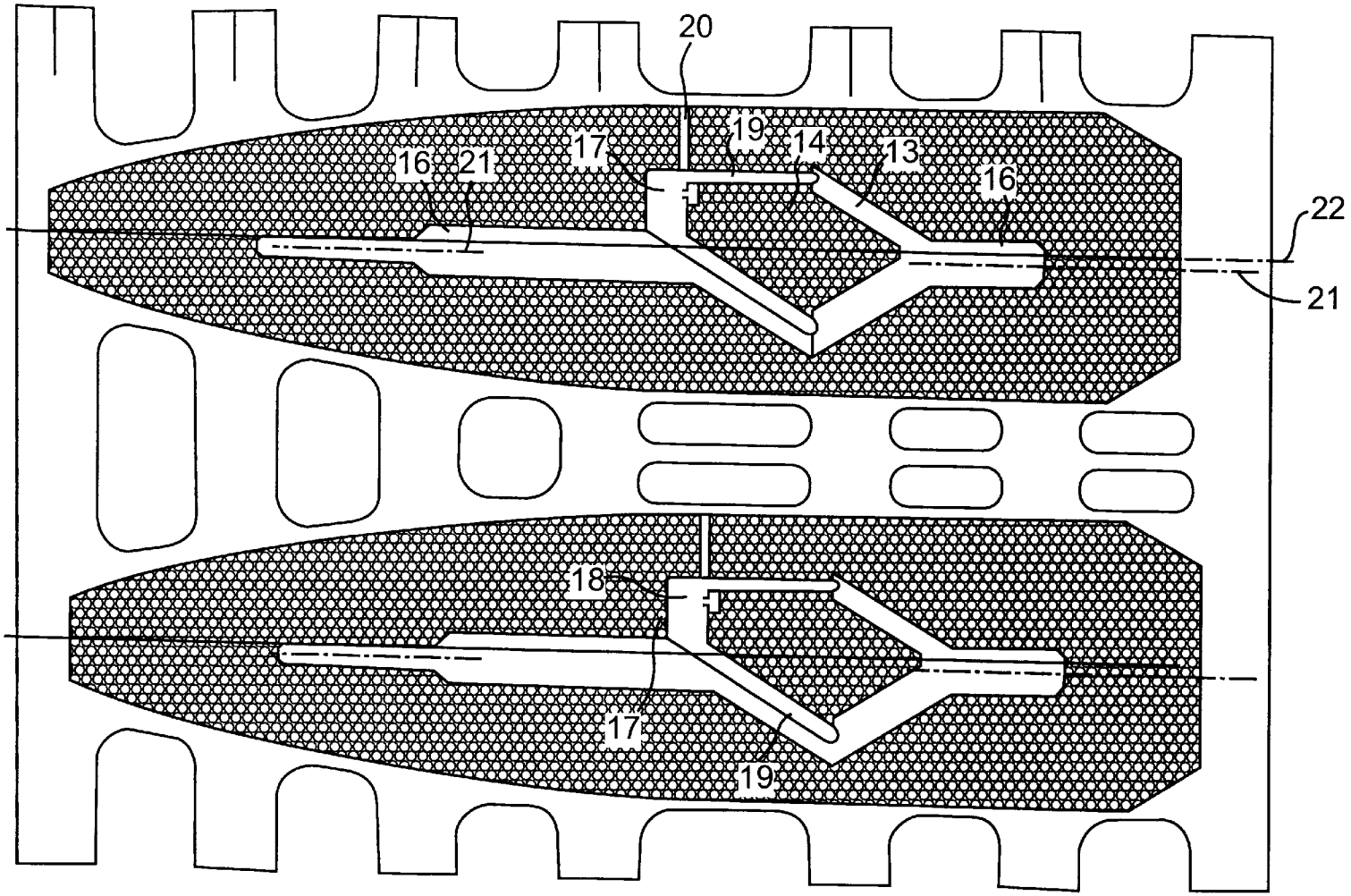
FIG. 4 shows a cross section through two sectional banks.

As can be seen in particular from FIG. 4, the air coolers inside the sectional banks are of asymmetrical form and are in an eccentric position inside the hollow space 13. This is because the banks 2 are loaded in a highly asymmetrical manner in the horizontal setup, since the gravitational force and the inertia force of the steam velocity are directed virtually perpendicularly to one another. However, this asymmetry relates mainly to the condensate loading in the bank, which with regard to the geometrical bank contours leads to likewise asymmetrical localization of the pressure minimum in the tube assembly.

The position of the minimum pressure dictates the position of the air cooler, since the latter is the location of the accumulation of the non-condensable gases. The condensate raining down from above increases the steam-side pressure loss in the bottom bank half and thus causes a downward shift in the pressure minimum. The air cooler is therefore configured and arranged in such a way that it takes into account said asymmetry. The intake of the inert gas is effected below the longitudinal center line 22 of the bank as a result of the cooler configuration selected.

The task of the air cooler 14 is to remove the non-condensable gases from the condenser. During this operation, the steam losses are to be kept as small as possible. This is achieved by the steam/inert-gas mixture being accelerated in the direction of suction passage 17. The high velocity results in good heat transfer, a factor which leads to the residual steam being largely condensed. For the purpose of accelerating the mixture, the cross section is dimensioned to be increasingly smaller in the direction of flow, as can be seen from FIG. 4. The inert gas is drawn off into the passage 17 via orifices 18. These orifices, which are made at the narrowest point of the cooler cover, represent the physical separation of the condensation space from the suction passage. They are distributed repeatedly over the entire tube length and, due to the generation of a pressure loss, cause the suction action to be homongeneous in all compartments of the condenser.

Part of the wall of the suction passage 17 is at the same time conceived as a cover plate 19. This plate is put over the tubes of the cooler and protects the latter from the steam and condensate flow flowing from top to bottom. Thus the entry direction of the mixture to be cooled is also predetermined, namely from the rear forward toward the orifices 18.

In order to direct the inert gas from the suction passage 17 to the suction apparatus (not shown), an appropriate number of tubes 5 are omitted from the banks 2. Depending on the size and staggering of the tubes 5, this concerns the omission of either one or two rows of tubes. A plurality of suction lines 20 penetrating upward through the bank are led out through the gap thus formed. These suction lines are run parallel to the bank up to the condenser base 8, where they lead into a collecting line 15 leading to the suction apparatus.

Compensating lanes 16 without tubes and leading into the hollow space 13 are provided upstream and downstream in the bank interior. These compensating lanes ensure that even the steam, enriched with inert gas, from the core of the front and rear half of the bank finds a frictionless path to the air cooler. To this end, as a result of the asymmetrical localization of the pressure minimum in the tube assembly, the longitudinal center line 21 of these residual-steam lanes is accordingly arranged below the longitudinal center line 22 of the sectional banks.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A steam condenser for on-floor arrangement with a steam turbine, said steam condenser comprising:

a plurality of tubes through which cooling water flows, said plurality of tubes being combined in separate sectional banks which are horizontally directed in their longitudinal extent, a plurality of said sectional banks being arranged one above the other in the vertical, wherein the tubes of one said sectional bank are arranged in rows and enclose a hollow space in which a cooler for non-condensable gases is arranged, a mixture of non-condensable gases and steam which collects in the hollow space of said one sectional bank being drawn off by the cooler, and the hollow space being connected to a compensating lane in an interior of said one sectional bank, which said compensating lane ensures that steam, enriched with inert gas, from a core of a front and a rear half of said one sectional bank is fed to the cooler, wherein a longitudinal center line of the compensating lane, on account of an asymmetrical condensate loading in the horizontally oriented sectional bank and an asymmetrical localization of a pressure minimum in said plurality of tubes, runs below a longitudinal center line of the sectional banks.

* * * * *